United States Patent [19]

Ragone et al.

[11] 4,055,855

[45] Nov. 1, 1977

[54] HOSPITAL GOWN

[76] Inventors: Alexander C. Ragone, 38 Celestial Lane, Levittown, N.Y. 11756; Inez Ragone, 1885 Leonard Lane, Merrick, N.Y. 11566

[21] Appl. No.: 706,302

[22] Filed: July 19, 1976

[51] Int. Cl.[2] ..... A41B 9/00

[52] U.S. Cl. ..... 2/114

[58] Field of Search ..... 2/114, 94, 125, 126, 2/DIG. 7; 224/6

[56] References Cited

U.S. PATENT DOCUMENTS

| | | | |
|---|---|---|---|
| 2,701,364 | 2/1955 | Palm | 2/114 |
| 3,504,984 | 7/1970 | Bush | 2/2.1 R |

*Primary Examiner*—Werner H. Schroeder
*Assistant Examiner*—Doris L. Troutman
*Attorney, Agent, or Firm*—Allen D. Brufsky

[57] ABSTRACT

A hospital gown including at least two panels removably secured about the front and back of a patient to form a garment having a pair of sleeves and an upper torso enveloping portion. Straps are provided in the interior of one sleeve for holding an I.V. tube and a pocket is sewn to the front of the torso enveloping portion to hold a medical diagnostic instrument which can be connected to the chest of the patient through an opening in the torso enveloping portion adjacent the pocket.

8 Claims, 2 Drawing Figures

HOSPITAL GOWN

BACKGROUND OF THE INVENTION

This invention relates to an improved hospital gown.

In hospital emergencies, time can be critical. When admitted in an emergency, a patient must be quickly disrobed so that the attending physician can perform a quick examination. The patient is usually provided with a gown whose sole utility is to cover the patient's body for modesty reasons. However, in an emergency, the gown can be useful as a holder for emergency equipment needed in either treating the patient or diagnosing his ailment, which may save critical time.

SUMMARY OF THE INVENTION

Accordingly, this invention provides an improved hospital gown which can be quickly and efficiently placed about the torso of a patient and includes means for holding an I.V. tube and heart beat recorder or like instrument. At least one of the sleeves of the gown is split along a seam and includes quickconnect fasteners, such as "Velcro" strips to secure the garment to an arm of the patient without raising and inserting his arm in the sleeve. The other sleeve of the gown includes a plurality of cloth strips for holding the I.V. tube. A pocket for holding a heart beat recording instrument or the like is sewn to the torso portion of the garment. The wires from the recorder are inserted through a reinforced opening in the torso portion of the garment so the recorder can be quickly attached to the chest of the patient.

BRIEF DESCRIPTION OF THE DRAWING

Further objects and advantages of the invention will become apparent from the following description and claims, and from the accompanying drawing, wherein:

DETAILED DESCRIPTION OF THE PREFERRED EMBODIMENT

Figure 1:
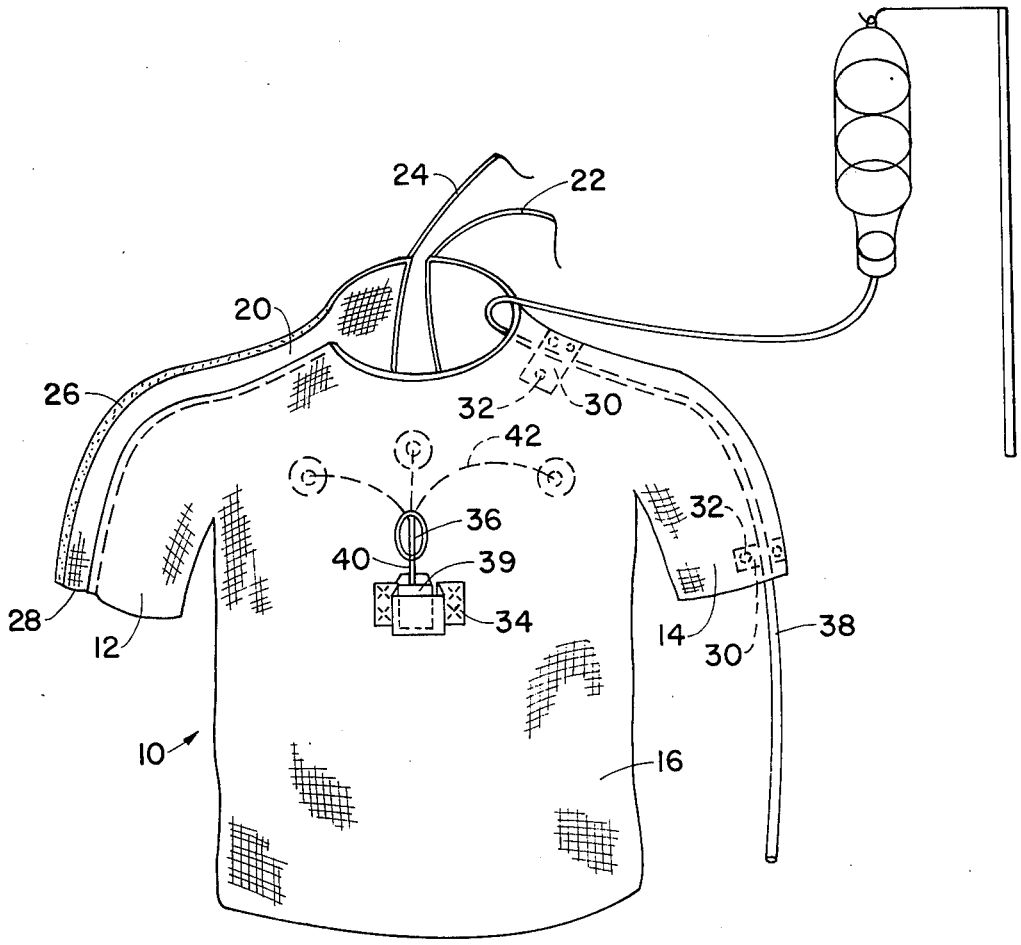
FIG. 1 is a front view in elevation of the hospital gown illustrating its utilitarian purpose.
Figure 2:
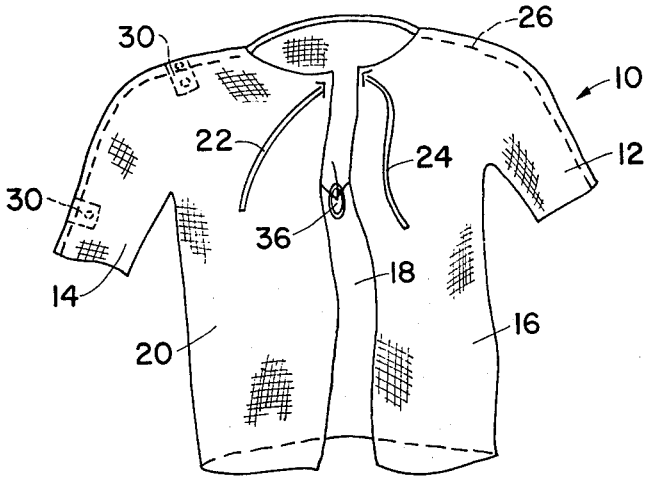
FIG. 2 is a rear view in elevation of the hospital gown of FIG. 1.

Referring now to the drawing in detail, wherein like numerals indicate like elements throughout the several views, the hospital gown 10 of the present invention includes a cloth fabric, having a pair of sleeves 12 and 14 and an upper torso enveloping portion 16.

Sleeve 12 is split along its seam as well as the back of torso portion 16 as indicated at 18 so as to provide a separate and removable panel 20. Tie strings 22 and 24 are connected to torso portion 16 adjacent the neck of the gown 10. The separate portions of sleeve 12 may be connected together and panel 20 to the remainder of the gown 10 by securing together "Velcro" tape fastening strips 26 and 28 located on each half of sleeve 12 along the seam. If desired, sleeve 14 may also be split and held together by "Velcro" fasteners to form another separate panel on the rear of the gown 10.

Secured to the interior of sleeve 14 across the seam, or in the case of a split sleeve, on one side of the sleeve seam, are a plurality of spaced, cloth straps 30 secured to sleeve 14 by snap fasteners 32. A pocket 34 is sewn to the front of torso portion 16 adjacent a reinforced opening 36 through the gown 10.

In use, the gown 10 may be quickly attached to a patient, even if he is in a comotose state, by inserting one arm in sleeve 14 and attaching panel 20 by securing together "Velcro" fasteners 26 and 28 on the other sleeve 12. If gown 10 is formed with three separate panels, as described above, the patient may merely be laid on the back panels and the front panel attached at both sleeves. The tie strings 22 and 24 are then secured about the neck of the patient.

An IV tube 38 may be threaded through straps 32 and secured to the arm of the patient. A heart beat recording instrument 39 of the like may be disposed in pocket 34 and its connecting wires 40 inserted through opening 36 and connected to the chest of the patient. If desired, lead wires 42 may be sewn directly to the gown 10 for connection to instrument 39.

It should also be understood that due to the removable connection of panel 20 (or panels as the case may be) the gown 10 may be readily stripped from the patient for quickly examining the upper torso of the patient or for providing extraordinary emergency measures.

We claim:

1. A hospital gown comprising:

at least two panels used to cover the front and back of the upper torso and arms of a patient, means for removably securing said panels together about the upper torso and arms of a patient to form a garment having a pair of sleeves and an upper torso enveloping portion, a pocket on a front surface of the upper torso enveloping portion of said garment for holding a medical diagnostic instrument, and an opening through the upper torso enveloping portion of said garment for attaching said medical instrument to the patient.

2. A hospital gown in accordance with claim 1 including means on at least one of said sleeves of said garment for holding a tube.

3. A hospital gown in accordance with claim 2 wherein said tube holding means includes a pair of spaced straps secured to said sleeve.

4. A hospital gown in accordance with claim 3 wherein said straps are removably secured to the interior of said sleeve.

5. A hospital gown in accordance with claim 4 wherein said straps are removably secured to the interior of said sleeve by snap fasteners.

6. A hospital gown in accordance with claim 1 wherein said means for removably securing said panels together includes "Velcro" fastener strips.

7. A hospital gown in accordance with claim 1 wherein said means for removably securing said panels together are located along the seams of the sleeves of said garment.

8. A hospital gown in accordance with claim 1 including electrical wire means attached to the torso portion of said garment adjacent said pocket.

* * * * *